US011085199B2

(12) United States Patent
Writesman

(10) Patent No.: US 11,085,199 B2
(45) Date of Patent: Aug. 10, 2021

(54) BREAK-AWAY BRACKET AND SPIKE

(71) Applicant: Mike Writesman, Eagleville, TN (US)

(72) Inventor: Mike Writesman, Eagleville, TN (US)

( * ) Notice: Subject to any disclaimer, the term of this patent is extended or adjusted under 35 U.S.C. 154(b) by 0 days.

(21) Appl. No.: 16/114,532

(22) Filed: Aug. 28, 2018

(65) Prior Publication Data

US 2019/0063102 A1 Feb. 28, 2019

Related U.S. Application Data

(60) Provisional application No. 62/550,715, filed on Aug. 28, 2017.

(51) Int. Cl.

| | |
|---|---|
| ***E04H 12/22*** | (2006.01) |
| ***E01F 9/685*** | (2016.01) |
| ***A47G 29/12*** | (2006.01) |
| ***E01F 9/642*** | (2016.01) |
| ***E01F 9/635*** | (2016.01) |

(52) U.S. Cl.

CPC ..... *E04H 12/2215* (2013.01); *A47G 29/1216* (2013.01); *E01F 9/635* (2016.02); *E01F 9/642* (2016.02); *E01F 9/685* (2016.02); *E04H 12/2269* (2013.01)

(58) Field of Classification Search

CPC ..... F16L 25/10; F16L 13/00; A47G 29/1216; Y10T 29/49826; Y10T 403/11; E04H 12/2215; E04H 12/2269; E01F 9/685; E01F 9/631; E01F 9/642; E01F 9/635; E01F 9/644; E01F 9/638

USPC ..... 248/156, 158, 159, 548; 403/361, 2; 52/848; 256/1, 65.14

See application file for complete search history.

(56) References Cited

U.S. PATENT DOCUMENTS

| | | | | |
|---|---|---|---|---|
| 4,923,319 A * | 5/1990 | Dent | F16D 9/06 285/3 |
| 4,926,592 A * | 5/1990 | Nehls | E01F 9/681 256/13.1 |
| 6,422,783 B1 * | 7/2002 | Jordan | E01F 9/685 256/13.1 |

(Continued)

*Primary Examiner* — Nkeisha Smith

(74) *Attorney, Agent, or Firm* — Wayne Edward Ramage; Baker Donelson

(57) ABSTRACT

A ground spike with an attachable mounting bracket. The ground spike has an angled tip adapted to be driven into the ground. The top of the spike has a mounting plate configured to be substantially flat with the ground surface when installed. The mounting plate can be of any suitable size or shape. A plurality of slots are located around the perimeter, and extend towards the center for a distance. An upper post fastening section with an open upper end receives and secures a post, such as a mailbox post. Holes in the sides of the fastening section allow for securely fastening the mounting bracket to the post, such as through screws or similar fastening means. The lower end of the post fastening section includes a second mounting plate, or flanges that extend outward at a right angle. The second mounting plate or flanges comprise a plurality of slots that are configured to align with the slots in the mounting plate attached to the spike. Mechanical fasteners, such as bolts and nuts, are used to fasten the mounting bracket to the spike mounting plate. Preferably, the mechanical fasteners are made of a material that breaks when a threshold level of force is applied to the post secured to the mounting bracket.

4 Claims, 3 Drawing Sheets

(56) References Cited

U.S. PATENT DOCUMENTS

| | | | | |
|---|---|---|---|---|
| 6,540,196 | B1 * | 4/2003 | Ellsworth | E01F 9/642 248/548 |
| 6,868,641 | B2 * | 3/2005 | Conner | E01F 9/635 52/165 |
| 7,195,222 | B2 * | 3/2007 | Dent | E01F 9/635 248/511 |
| 7,434,778 | B2 * | 10/2008 | Leahy | E01F 9/631 248/530 |
| 7,537,412 | B2 * | 5/2009 | Lewis | E01F 9/642 40/606.01 |
| 8,303,209 | B2 * | 11/2012 | Lewis | E01F 9/635 248/219.1 |
| 2001/0027620 | A1 * | 10/2001 | Wooten | F41G 1/35 42/124 |
| 2003/0205006 | A1 * | 11/2003 | Conner | E01F 9/635 52/98 |
| 2011/0303806 | A1 * | 12/2011 | Samaras | A01M 31/06 248/156 |
| 2011/0308990 | A1 * | 12/2011 | Pounders | E04H 12/2215 206/525 |
| 2013/0038770 | A1 * | 2/2013 | Hawkins | F16M 11/105 348/333.01 |
| 2018/0078069 | A1 * | 3/2018 | Dry | A47G 29/1216 |

* cited by examiner 22
3-1/2" x 3-1/2" x 6"
OR
4" X 4" x 6"
TUBE STEEL 3/16"
GAGE 22
24
30
16
26a 16
30

12
14
12
14

26
28

16
18
19

BREAK-AWAY BRACKET AND SPIKE

This application claims benefit of and priority to U.S. Provisional No. 62/550,715, filed Aug. 28, 2017. The specification, figures, and complete disclosure of U.S. Provisional No. 62/550,715 are incorporated herein in their entireties by specific reference for all purposes.

FIELD OF INVENTION

This invention relates to a break-away bracket and stake for installation of a mailbox, fence post, or similar item.

BACKGROUND OF THE INVENTION

Mailboxes, fences, and similar items often are mounted in the ground, with the lower portion of a post extending some distance therein. Unfortunately, these items often are mounted along roadways or other areas with vehicular traffic, and are frequently struck by a vehicle, causing damage to the mailbox and bending the post or pulling it from the ground. This requires expensive and time-consuming repairs.

Accordingly, there is a need for a device for use with mailboxes and similar items that allows for quick installation of a replacement.

SUMMARY OF THE INVENTION

In various exemplary embodiments, the present invention comprises a ground spike with an attachable mounting bracket. The ground spike comprises a lower portion with an angled tip adapted to be driven into the ground. The lower portion can be of any suitable length. The top of the spike comprises a mounting plate configured to be substantially flat with the ground surface when installed. The spike and mounting plate can be integrated, or the mounting plate may be attachable to the top of the spike. The spike and mounting plate may be made of any suitable material, including, but not limited to, plastic, metal, or steel.

The mounting plate can be of any suitable size or shape. A plurality of slots are located around the perimeter, and extend towards the center for a distance. The slots may be evenly spaced, and centered along each side. The mounting plate also can be used without a spike, such as when mounted on a concrete pad. A plurality of holes may be provided in the mounting plate to facilitate mounting in this fashion.

The mounting bracket comprises an upper post fastening section with an open upper end adapted to receive and secure a post, such as a mailbox post. Holes in the sides of the fastening section allow for securely fastening the mounting bracket to the post, such as through screws or similar fastening means. The lower end of the post fastening section may comprise a second mounting plate, or may have flanges that extend outward at a right angle. The second mounting plate or flanges comprise a plurality of slots that are configured to align with the slots in the mounting plate attached to the spike. Mechanical fasteners, such as bolts and nuts, are used to fasten the mounting bracket to the spike mounting plate. Preferably, the mechanical fasteners are made of a material that breaks when a threshold level of force is applied to the post secured to the mounting bracket, but lower than the force necessary to bend or distort the mounting bracket, spike, or other components, or to disturb or pull the spike from the ground. Fasteners may be made of aluminum, nylon, or similar materials.

Accordingly, when a mailbox installed using the present invention is struck by a vehicle, the mechanical fasteners break, allowing the post and mounting bracket to detach from the spike and mounting plate. The mounting bracket can then be easily removed from the post, installed on a replacement mailbox box post, and reattached to the mounting plate on the spike using a new set of fasteners. The slots allow the lower portion of the mechanical fastener (such as the bolt) to be easily slid into place when the mounting plate is close to the ground. The slots in the mounting bracket allow the mechanical fastener to be easily slid into place when both pieces are aligned, and also permits the mechanical fastener to be secured at different points along the length of the slot.

DETAILED DESCRIPTION OF EXEMPLARY EMBODIMENTS

Figure 1:
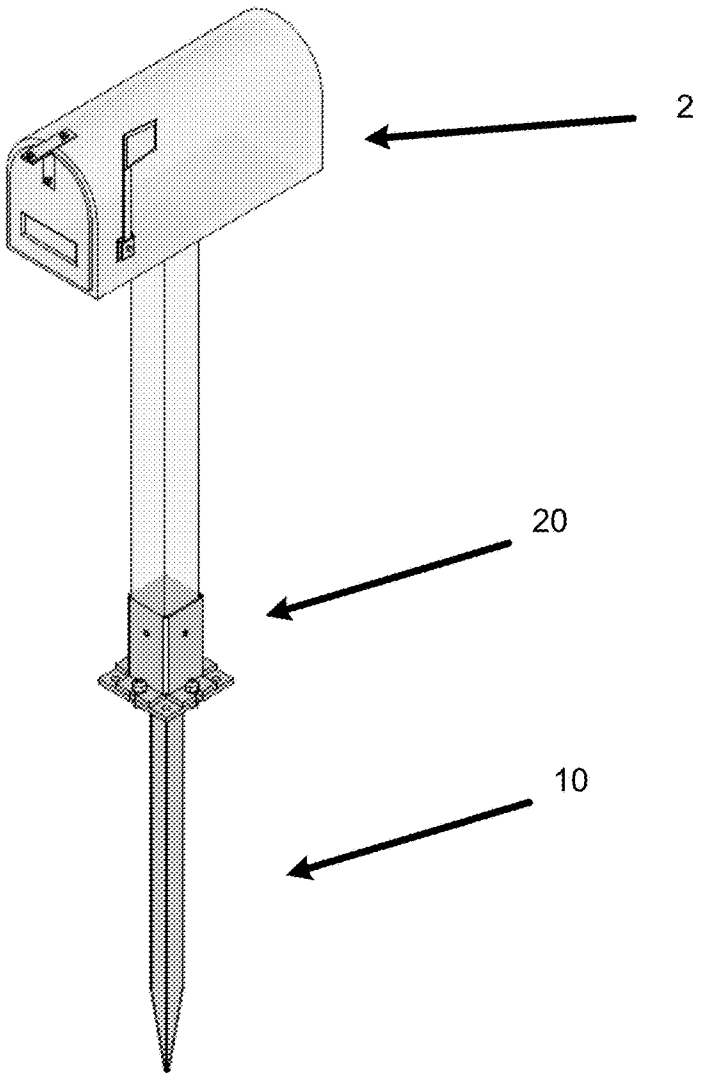
FIG. 1 is a perspective view of the present invention in use with a mailbox.
Figures 2A, 2B, 2C, 2D, 2E, 2F:
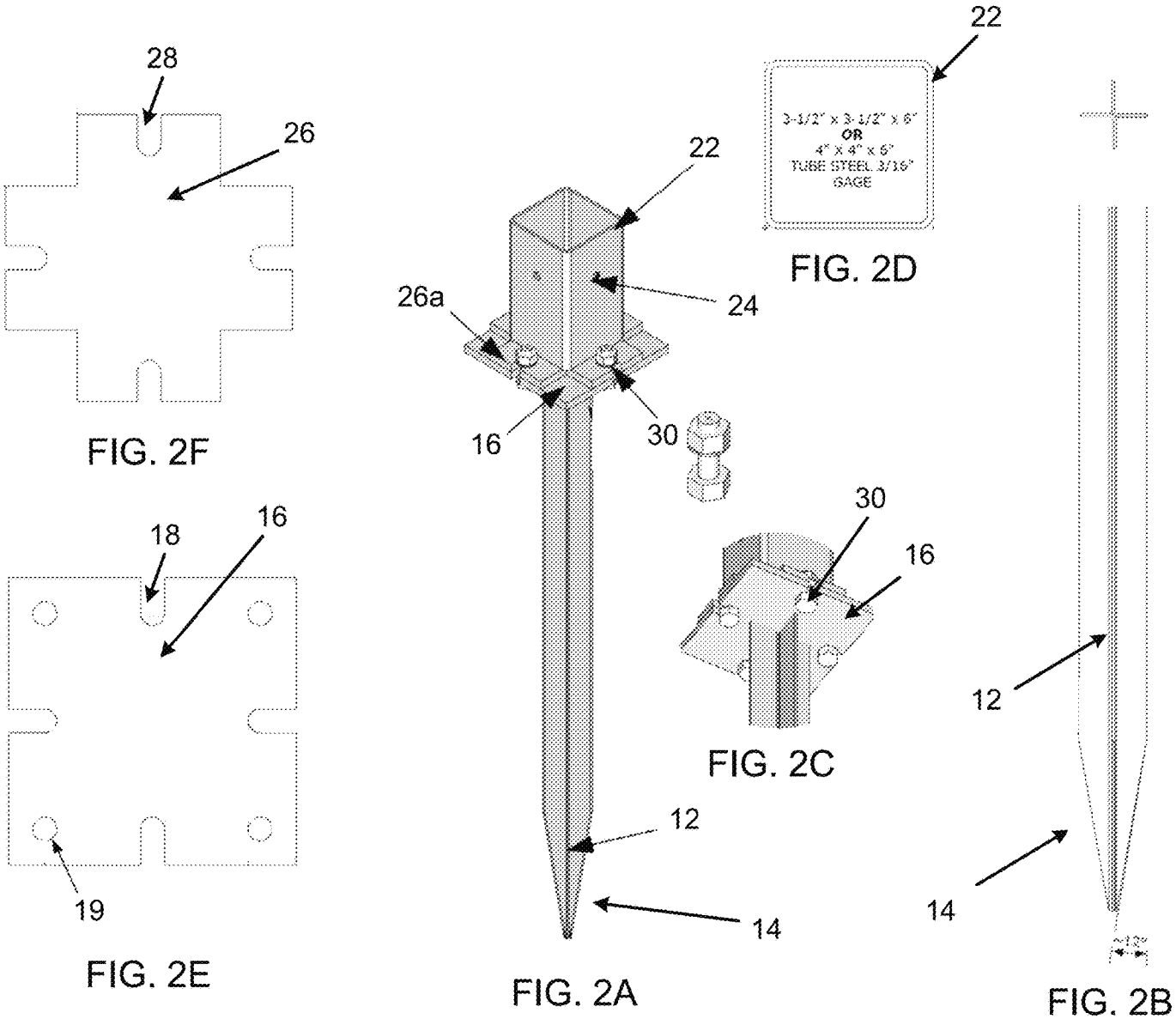
FIG. 2A shows a view of a ground spike and mounting bracket in accordance with an embodiment of the present invention.
FIG. 2B shows a view of the lower end of the ground spike of FIG. 2A.
FIG. 2C shows a bottom perspective view of the mounting bracket and plates of FIG. 2A.
FIG. 2D shows a top cross-section of the mounting bracket of FIG. 2A.
FIG. 2E shows a top view of a spike mounting plate.
FIG. 2F shows a bottom view of a post mounting plate.
Figure 3A:
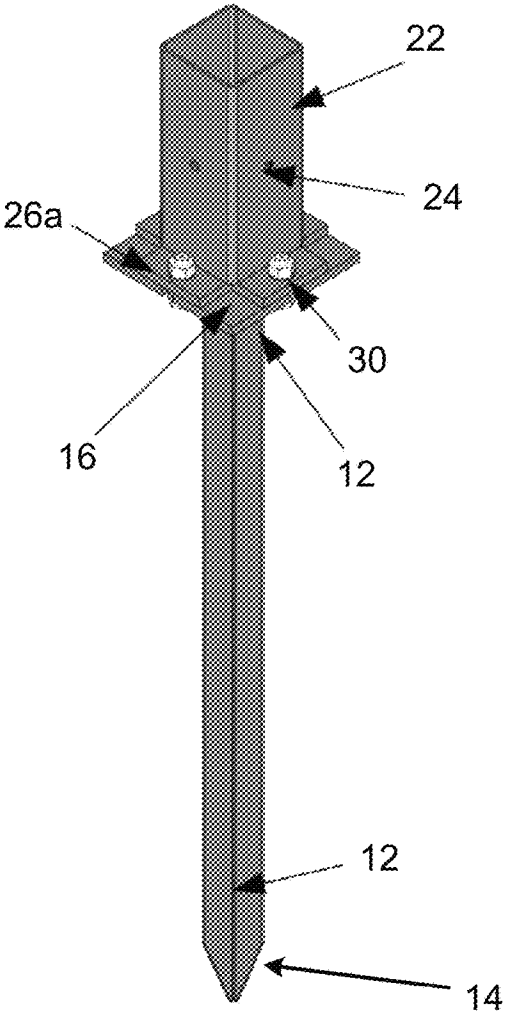
FIG. 3A shows a view of a ground spike and mounting bracket in accordance with another embodiment of the present invention.
Figure 3C:
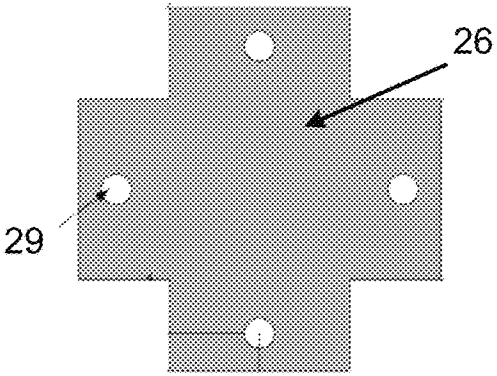
FIG. 3C shows a bottom view of another embodiment of a post mounting plate.
Figure 3B:
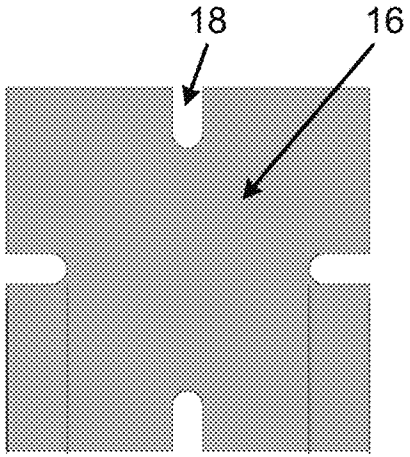
FIG. 3B shows a top view of another embodiment of a spike mounting plate.

In various exemplary embodiments, as seen in FIGS. 1-3, the present invention comprises a ground spike 10 with an attachable mounting bracket 20. The ground spike comprises a lower portion 12 with an angled tip 14 adapted to be driven into the ground. The lower portion can be of any suitable length; in one embodiment, the length of the spike is from approximately 24 to approximately 30 inches.

The top of the spike comprises a mounting plate 16 adapted to be substantially flat with the ground surface when installed. The spike and mounting plate can be integrated, or the mounting plate may be attachable to the top of the spike. The spike and mounting plate may be made of any suitable material, including, but not limited to, plastic, metal, or steel.

The mounting plate can be of any suitable size or shape. In the embodiment shown, the mounting plate is a 6"×6" square, ⅜" in thickness. A plurality of slots are located around the perimeter, and extend towards the center for a distance. The slots may be evenly spaced, and centered along each side.

In yet another embodiment, the mounting plate can be used without a spike, such as when mounted on a concrete pad. As seen in FIG. 2E, a plurality of holes 19 may be provided in the mounting plate to facilitate mounting in this fashion.

The post mounting bracket comprises an upper post fastening section 22 with an open upper end adapted to receive and secure a post, such as a mailbox post 2. Holes 24 in the sides of the fastening section allow for securely fastening the mounting bracket to the post, such as through screws or similar fastening means.

The lower end of the post fastening section 22 may comprise a second (or post) mounting plate 26, or may have flanges 26*a* that extend outward at a right angle. The second mounting plate or flanges comprise a plurality of slots 28 that are configured to align with the slots 18 in the mounting plate attached to the spike. Mechanical fasteners 30, such as bolts and nuts, are used to fasten the mounting bracket to the spike mounting plate.

Preferably, the mechanical fasteners are made of a material that breaks when a threshold level of force is applied to the post secured to the mounting bracket, but lower than the force necessary to bend or distort the mounting bracket, spike, or other components, or to disturb or pull the spike from the ground. Fasteners may be made of aluminum, nylon, or similar materials.

Accordingly, when a mailbox installed using the present invention is struck by a vehicle, or a force is applied to the mailbox post laterally or vertically or a combination there, the mechanical fasteners break, allowing the post and mounting bracket to detach from the spike and mounting plate without breaking, or causing damage to, the mounting bracket, spike, or mounting plate, or disturbing the installation of the spike or mounting plate. The mounting bracket can then be easily removed from the post, installed on a replacement mailbox box post, and reattached to the mounting plate on the spike using a new set of fasteners. The slots allow the lower portion of the mechanical fastener (such as the head of a bolt) to be easily slid into place when the mounting plate is close to the ground. In some embodiments, the area of the slots in the mounting bracket may be raised slightly above the plane of the main section of the mounting bracket, further facilitating the sliding placement of the head of the bolt when the mounting plate is flat with the ground or a concrete or similar pad. The slots in the mounting bracket allow the mechanical fastener to be easily slid into place when both pieces are aligned, and also permits the mechanical fastener to be secured at different points along the length of the slot. However, as seen in FIG. 3, in an alternative embodiment the second mounting plate 26 may comprise a plurality of holes 29 to receive the mechanical fasteners.

Thus, it should be understood that the embodiments and examples described herein have been chosen and described in order to best illustrate the principles of the invention and its practical applications to thereby enable one of ordinary skill in the art to best utilize the invention in various embodiments and with various modifications as are suited for particular uses contemplated. Even though specific embodiments of this invention have been described, they are not to be taken as exhaustive. There are several variations that will be apparent to those skilled in the art.

What is claimed is:

1. A break-away post mounting system, comprising:

a spike with a top and a bottom;

a rectilinear first mounting plate affixed to the top of the spike, said first mounting plate comprising four sides, each side with a slot with two edges extending for a length through the first mounting plate and extending inward from a corresponding side, wherein two edges are parallel for a majority of the length of each slot;

a post mounting bracket with an upper end and a lower end, the upper end comprising a hollow post fastening section with an outer perimeter with an open end adapted to receive a lower end of a post, and the lower end comprising a second mounting plate with four flanges extending beyond the outer perimeter of the upper end, each of said flanges comprising a hole or slot extending therethrough;

a plurality of break-away nut-and-bolt fasteners, each fastener comprising a nut, and corresponding bolt, said bolt with a first end and a second end and a length therebetween, the first end comprising a bolt head and the second end configured to receive a corresponding nut, wherein the length therebetween is threaded and of constant diameter;

wherein the second mounting plate is configured to be directly attached to the first mounting plate with no space therebetween by insertion of each bolt into a corresponding slot of the first mounting plate with the bolt head positioned below the first mounting plate opposite the second mounting plate, and through a corresponding hole or slot of the second mounting plate, with the corresponding nut fastened on the second end of the corresponding bolt;

further wherein the break-away fasteners are configured to break at a first level of force, wherein the first level of force is insufficient to bend, distort or damage the spike, first mounting plate, or post mounting bracket.

2. The system of claim 1, wherein the post fastening section comprises a polygon in cross-section with the outer perimeter.

3. The system of claim 1, wherein the plurality of nuts are made of aluminum or nylon.

4. The system of claim 1, wherein the second mounting plate slots or holes are configured to align with the slots in the first mounting plate.

* * * * *